US007001357B2

(12) United States Patent
Berry, Sr.

(10) Patent No.: US 7,001,357 B2
(45) Date of Patent: Feb. 21, 2006

(54) BABY SAFE FEEDER WITH INTEGRALLY FITTED FOOD CONTAINER

(76) Inventor: Donald P. Berry, Sr., 391 Magnolia Pl., DeBary, FL (US) 32713

( * ) Notice: Subject to any disclaimer, the term of this patent is extended or adjusted under 35 U.S.C. 154(b) by 293 days.

(21) Appl. No.: 10/359,428

(22) Filed: Feb. 7, 2003

(65) Prior Publication Data

US 2004/0158200 A1 Aug. 12, 2004

(51) Int. Cl.
*A61J 7/00* (2006.01)
*A61J 17/00* (2006.01)

(52) U.S. Cl. ..... 604/77; 606/234

(58) Field of Classification Search ..... 604/77–79; 606/234–236; 215/11.1–11.6, 273–277, 215/283; 426/115, 117; 210/452–453
See application file for complete search history.

(56) References Cited

U.S. PATENT DOCUMENTS 3,892,243 A * 7/1975 Bell ..... 606/234
5,176,705 A * 1/1993 Noble ..... 604/77
5,395,392 A * 3/1995 Suhonen ..... 606/234
6,524,272 B1 * 2/2003 Berry, Sr. ..... 604/77
6,685,843 B1 * 2/2004 Leaverton ..... 210/805

* cited by examiner

*Primary Examiner*—Michael J. Hayes
(74) *Attorney, Agent, or Firm*—Allen, Dyer, Doppelt, Milbrath & Gilchrist, P.A.

(57) ABSTRACT

A device for feeding a young child without the threat of choking, this device comprising a handle member in combination with an elongate food-receiving mesh container having an aperture in one end thereof. A ring component too large to swallow is mounted in the aperture. One end of the handle member has a circularly disposed sealing surface, and having a securing member around its adjacent exterior surface. A closure ring having a securing member around its interior surface is able to interfit with the securing member of the handle end. The closure ring has a central aperture of a size to closely receive the container, but not permitting the passage of the ring component. When the closure ring has been tightened upon the handle end, the ring component will tightly engage the circularly disposed sealing surface on the handle, holding the container in an operative position.

20 Claims, 1 Drawing Sheet

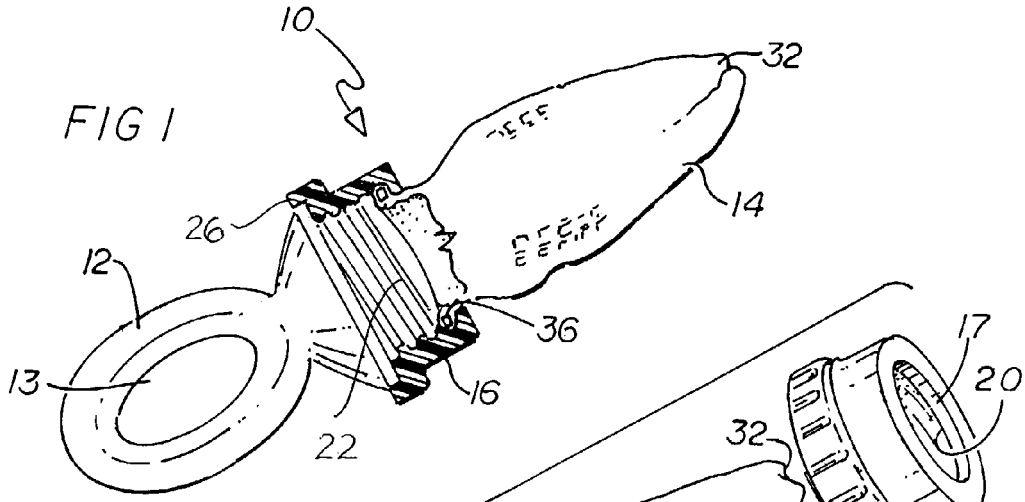
FIG 1
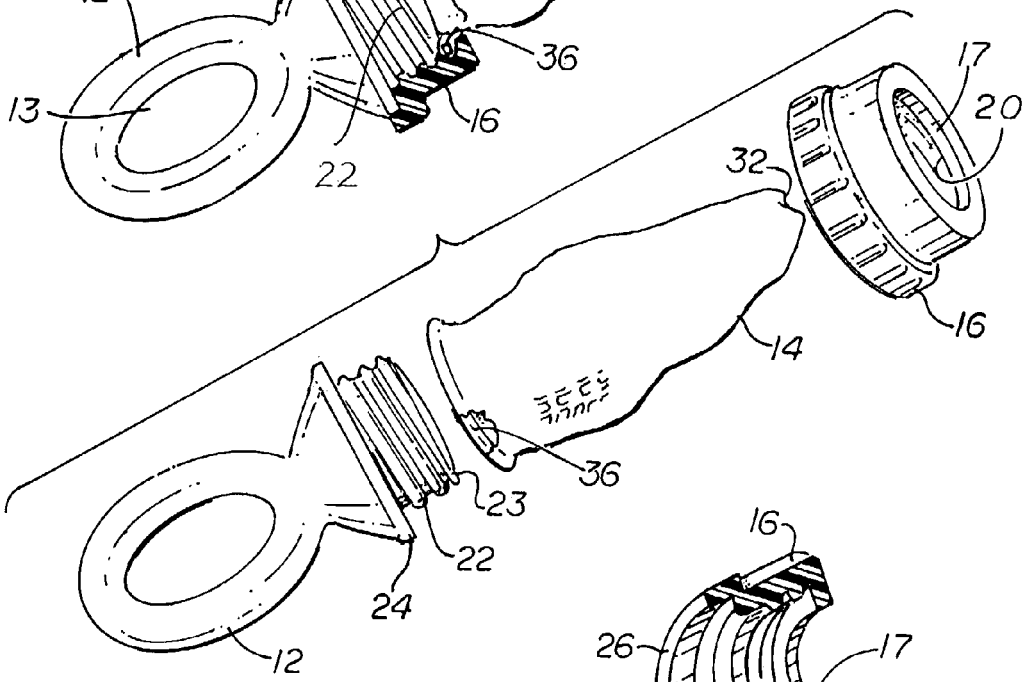
FIG 2
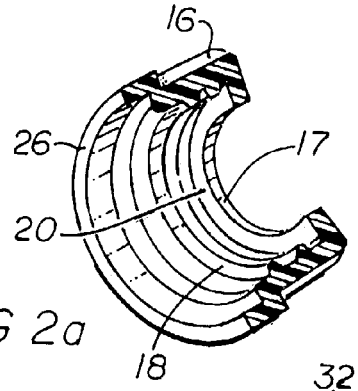
FIG 2a
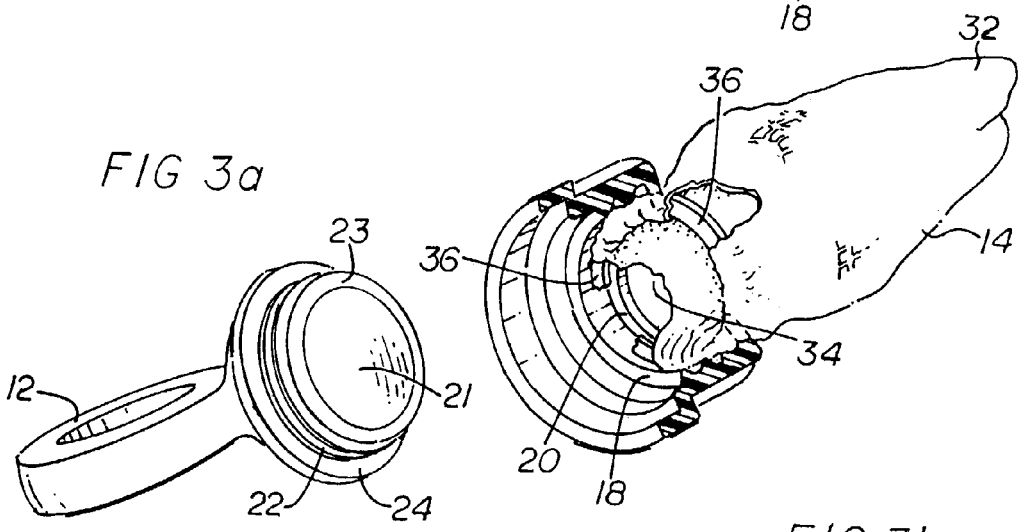
FIG 3a
FIG 3b

BABY SAFE FEEDER WITH INTEGRALLY FITTED FOOD CONTAINER

RELATIONSHIP TO PREVIOUS PATENT

This invention bears a close relationship to my earlier issued U.S. Pat. No. 5,364,348 entitled "Device for Supplying Food to a Person while Avoiding Choking," which issued on Nov. 15, 1994, and to my co-pending application Ser. No. 09/588,360, which issued on Feb. 25, 2003 as U.S. Pat. No. 6,524,272, and is entitled "Baby Safe Feeder with Integral Mesh Bag."

BACKGROUND OF THE INVENTION

Almost everyone is well aware of the fact that liquid food can be supplied to a child from a bottle provided with a nipple, with such nipple often being held in place by virtue of mounting the base portions of the nipple in a closure ring that is equipped with internal screw threads. Used with this nipple and closure ring is a bottle having external threads extending around the open end, so that by tightly screwing the closure ring onto the top of the bottle, a liquid tight arrangement is brought about. After the milk, orange juice or other liquid food has been fully administered, the closure ring is unscrewed from the top of the bottle so that a thorough washing of all of these components can be readily brought about.

Typically the mother or other care giver introduces the infant to spoon feeding in the age range of six to eight months, but sometimes the transition from nipple to spoon can be difficult for the infant.

My issued U.S. Pat. No. 5,364,348 provided a means whereby a transitional phase is set up during the baby's development between the milk-nipple stage and the food-spoon stage. The administering of certain foods, such as semi-solid foods, in the early period of development becomes easier because of the baby's familiarity with a nipple. This makes subsequent spoon training faster and easier, because when a spoon is first presented with food in it, the baby will already be familiar with the food. Consequently, crossing the "spoon barrier" becomes a simple matter.

Another important consideration is the fact that when an infant is starting to take semi-solid and solid food, the possibility of choking can be a constant threat. Therefore, when a child is being given a piece of a hot dog, for example, the mother or other care giver should cut the hot dog longitudinally before cutting it into pieces. This is advisable because a generally cylindrically shaped piece of hot dog is of a configuration that could easily form a blockage in the throat of a child or impaired adult, and cause him or her to choke to death if help is not quickly forthcoming.

I am aware that there are many items on the market, such as baby crackers, baby cookies, baby toast and the like that are intended as snacks for an infant to chew on while teething or while the infant has only a few teeth. Even though such items are ostensibly for infants, it is nevertheless quite possible for an infant or impaired adult to break off a piece of such an item and choke on it.

In accordance with the teachings of my above-mentioned patent, I have provided an elongate food-receiving container of fine mesh construction such that relatively soft, solid or semi-solid food items placed in the elongate container can be dissolved by the person's saliva and thereafter ingested, this being accomplished without any possibility of the person choking upon such food or any part of the feeder device.

Although my earlier issued patent has been quite successfully marketed as a "Baby Safe Feeder," it is entirely possible that after a mother or other care giver has washed out the handle member, the closure ring and the food dispensing container of fine mesh construction and left these members to dry in a location reachable by a child, the child could possibly grasp the mesh container, place it in his or her mouth, and then choke on it.

It was in an effort to supplement and improve upon the safety of my previously patented device that the invention represented by my recently-allowed patent application taught the use of a relatively large ring secured to the open end of the mesh container, making the container virtually impossible for a child to swallow.

More recently, I have developed an improved procedure for securing the mesh food-receiving container in contact with the handle member in such a manner as to prolong the useful life of the mesh container.

SUMMARY OF THE INVENTION

In accordance with this invention, I provide a device for feeding food, typically semi-solid food, to a young child or to a person unable to manage the use of a fork or spoon, without the threat of the person choking. In other words, my invention is usable in the nursery, or in a location involving the administration of food by a care giver to a child, or to an adult with a physical or mental impairment.

This device comprises a handle member in combination with a food-receiving member in the form of an elongate container of fine mesh material that has an open end and a closed end. Ring means are affixed in the open end of the elongate container, through which semi-solid food can be inserted into the food-receiving member. The handle member has a generally circularly configured end, around which is defined a circularly disposed sealing surface. Around an adjacent exterior surface of the handle end, suitable securing means are disposed, which is to be utilized with a closure ring equipped with complimentary securing means that enables the closure ring to be secured upon the handle end.

The closure ring has a central aperture of a size to receive the elongate food-receiving container, with an inner shoulder disposed around the aperture. This inner shoulder is sized to receive the ring means of the elongate container, but preventing the passage of the ring means through the aperture in the closure ring.

Importantly, the previously mentioned circularly disposed sealing surface defined around the handle end is approximately the same diameter as the ring means, so as to permit the ring means to come into close contact with the sealing surface when the closure ring is tightened upon the handle end. In this way, no part of the mesh material of the elongate food-receiving container resides between the securing means of the closure ring and the complimentary securing means on the end of the handle, enabling the closure ring to be secured upon the handle end.

In the preferred instance, the securing means take the form of threads, with internal threads on the ring member being readily able to be tightly interfitted with external threads of a like nature utilized around the circularly configured end of the handle.

The ring means for holding the aperture of the elongate food-receiving container in a wide open position is configured to be of a sufficiently large diameter as to make it highly unlikely that the elongate container could be swallowed by a child or impaired adult.

As a consequence of this arrangement, upon semi-solid food being placed in the elongate container of mesh material, and the mesh container inserted through the aperture of the internally threaded closure ring, the closure ring can be tightened upon the handle member so as to form a unitary device. The food-receiving container, upon then being placed in the mouth of the person, enables the food in latter member to at least partially dissolve in the mouth of the person.

Examples of solid or semi-solid food that can be readily dissolved in the mouth of the person are pieces of bread, small pieces of cooked potato, pretzel pieces, Jello, certain cereals, cookie crumbs and rock candy. Further examples are carrots, apples, cooked or raw food and the like.

I typically construct the handle member of plastic, preferably a strong, industrial grade plastic, although I am not to be limited to this. I typically create the mesh container out of suitable cloth, such as nylon or polyester, although certain closely woven plastic meshes may also be utilized in certain circumstances. I am obviously not to be limited to these materials.

It is thus to be seen that a primary object of this invention is to provide a feeding device for safely feeding an infant, small child or impaired adult by the use of means for tightly securing an elongate food-receiving bag of fine mesh construction upon a handle member by the use of an apertured closure ring, in which ring the elongate mesh bag containing semisolid food is received, with no part of the mesh bag being permitted to reside between the securing means utilized between the closure ring and the handle member.

It is another object of this invention to provide a feeding device of simple and straightforward configuration, that can be manufactured and marketed at a relatively low cost, yet forming an entirely safe feeding arrangement for a child or impaired adult, with the semi-soft food to be utilized in this device being contained in an elongate mesh container or bag held in place by an apertured closure ring, with this being accomplished in such a manner as to assure a particularly long life of the mesh container.

It is yet another object of this invention to provide a baby safe container utilizing an elongate mesh bag in which semisolid food is contained, which mesh bag can be easily filled with soft food, and later readily separated from the closure ring for easy cleaning.

It is yet still another object of this invention to provide a food-receiving container of fine mesh construction such that relatively soft, solid or semi-solid food items can be readily inserted into an aperture in one end of the food-receiving container, with ring means utilized in the aperture preventing the mesh container being swallowed by a child or impaired adult when the components have later been separated for cleaning.

It is yet still another object of this invention to provide a means for tightly securing an elongate food-receiving container of fine mesh construction upon a handle member by the use of an apertured closure ring, with ring means being secured in an aperture provided in one end of the mesh container, through which soft food is inserted, with the diameter of the ring means being sufficiently large as to prevent the mesh container, after being emptied, washed and then laid out to dry, being swallowed by a child or impaired adult.

It is yet another object of this invention to provide a multi-component feeding device including an elongate mesh component that can be readily assembled and easily filled with soft food when ready to be put into use, but which device can be quickly disassembled for sterilization subsequent to use, including the ability of the mesh container to be turned inside out for thorough cleaning, with no danger of any component of this device being swallowed at any time by a child or impaired adult.

These and other objects, features and advantages will become more apparent from a study of the appended figures of drawing.

BRIEF DESCRIPTION OF DRAWINGS

FIG. 1 is an assembled view of my novel baby safe feeder, by the use of which semi-solid food able to be readily dissolved is placed in a food-receiving member in the form of an elongate container of fine mesh material, with this arrangement making it possible for certain foods to be safely administered to an infant, small child or impaired adult;

FIG. 2 is an exploded view of my baby safe feeder, revealing in greater detail, the separate components that constitute this invention, which are the handle member, the mesh food-receiving container equipped with a rigid or semi-rigid ring, and the internally threaded closure ring having an internal shoulder designed to engage the rigid or semi-rigid ring secured in the open end of the elongate food-receiving container, thus holding the food-receiving container in a highly desirable relationship with a circularly disposed sealing surface defined on the handle end;

FIG. 2*a* is a fragmentary view showing the interior of the internally threaded closure ring, including the inner shoulder located relatively close to the threads, which shoulder is of approximately the same diameter as that of the ring secured in the end of the mesh container;

FIG. 3*a* is a fragmentary view of the handle, with this view clearly illustrating the circularly disposed sealing surface on the handle end, which is positioned to be contacted by the rigid or semi-rigid ring of the mesh container when the internally threaded closure ring has been caused to engage the threads disposed around the end of the handle member; and FIG. 3*b* is a fragmentary view illustrating the rigid or semi-rigid ring permanently attached to the open end of the food-receiving container, with latter ring in this instance illustrated in engagement with the internal shoulder of the internally threaded closure ring that is designed to engage the threads on the handle end.

DETAILED DESCRIPTION

With initial reference to FIG. 1, it will be seen that I have illustrated my improved baby safe feeding device 10 in its fully operative position, such that readily dissolvable food may be administered to a child or impaired adult without the threat of choking. The device 10 comprises a handle member 12 that can be readily grasped by the child or impaired adult, with this handle member being utilized in combination with an integrally attached elongate food-receiving container 14, removably held in place on the handle member by the use of a threaded closure ring or cap member 16.

The handle member 12 is typically of plastic, preferably of a strong, industrial grade plastic that can resist being brought to sterilization temperatures a large number of times without significantly deteriorating.

The closure ring or cap member 16 is shown in cross section in FIG. 1 in order to reveal that the internal threads 18 of the closure ring 16 interfit with the external threads 22 of the handle member 12. Others of the figures of drawing show these threads more clearly, and I may refer to the threads 18 and 22 as securing means.

The closure ring or threaded cap 16 has a central aperture 17, closely associated with which is an inner shoulder 20. These are visible in FIG. 2, and best seen in FIG. 2*a*.

The food-receiving member 14 is in the form of an elongate container or bag constructed of mesh material, having a closed end 32 and an open end 34. The member 14 may be of cloth, such as nylon or polyester, although certain closely woven plastic meshes may also be utilized in certain circumstances. Secured in the open end or aperture 34 of the mesh member 14 is a ring means 36, secured in place by a permanent adhesive, by stitching, by sonic welding, by injection molding, or by other suitable means. Through the aperture 34 of the elongate mesh container 14, soft or semi-solid food may be readily inserted into the container. The ring means or ring component 36, partially visible in FIG. 2 and better seen in FIG. 3*b*, may be of rigid or semi-rigid construction, and it serves multiple purposes.

It is because of the securing of the ring means 36 in the open end of the mesh food container that the mother or other care giver can safely launder the food dispensing member 14 without the fear of this member being swallowed should the member 14 and/or the somewhat larger closure ring 16 be inadvertently left, after use, in a position easily reached by a child or impaired adult. I have found that the food-receiving container or mesh bag 14 can survive a large number of washings without damage.

One purpose of the ring means or ring component is to hold the aperture 34 of the elongate container in an open position to simplify the placement of food in the container; note FIG. 3*b*. As previously mentioned, it is important to note that the ring means 36 is of such a diameter as to serve the additional purpose of making it highly unlikely that the elongate container 14 could be swallowed by a child or impaired adult.

The handle member 12 may have a central aperture 13, and more significantly, the handle member has a circularly configured handle end 21. Most importantly, a circularly disposed sealing surface 23 is defined around the handle end 21, with this sealing surface or contact surface best seen in FIG. 3*a*. Significantly, the sealing surface 23 is approximately the same diameter as the ring means 36. The portion of the handle end surrounded by the circularly disposed sealing surface 23 may be flat or slightly domed.

The central aperture 17 of the closure ring 16 is of a size to receive the elongate container 14 in which soft, readily dissolvable food has been placed. Around the aperture 17 is disposed the previously mentioned inner shoulder or internal shoulder 20, which is of a diameter to closely receive the ring means 36. However, the aperture 17 of the closure ring 16 is sufficiently smaller than the ring means or ring component 36 as to prevent the ring means passing through the aperture of the closure ring. In all instances the ring means 36 is sufficiently rigid or sturdy as to prevent it being pulled through the aperture 17 of the closure member 16, even if the caregiver fails to properly tighten the closure member upon the handle member.

The closure ring 16 is utilized in operative association with the handle end 21, around an interior surface of which closure ring, the securing means 18 is disposed; note FIGS. 2*a* and 3*b*. This securing means preferably involves threaded means complementary to the threaded securing means 22 disposed on the handle end. The threaded securing means 22 of the handle end is best seen in FIG. 2, and of course was shown in FIG. 1 in an interfitted relationship with the internal threads 18 of the closure ring. As is obvious, this arrangement enables the closure ring 16 to be tightly yet removably interlocked upon the end of the handle 12.

As a result of this arrangement, when the elongate food-receiving container 14 has been inserted through the aperture 17 of the closure ring 16, and the closure ring has been moved into contact with the end of the handle and into engagement with the external threads 22 of the handle, and the closure ring thereafter tightened, the inner shoulder 20 of the closure ring 16 will cause the ring means or ring component 36 to tightly engage the circularly disposed sealing surface 23 on the handle.

It is to be noted that in accordance with this arrangement, an important purpose is served in that none of the mesh container 14 is engaged between the interfitting threads 18 and 22.

An optional skirt 26 on the closure ring 16 may surround the flange 24 on the handle member when the closure ring has been tightened upon the end of the handle. The flange 24 supports skirt 26 in the event that the user should drop the baby safe feeder, or should a child pound on the table with the device. The skirt 26 is also easy to grip at the time the care giver is endeavoring to tighten the closure ring 16 onto the threads of the handle member 12.

As to the utilization of my improved baby safe feeder, upon the food containing elongate container 14 being placed in the mouth of the person, the food will at least partially dissolve in the mouth of the person without a choke hazard being presented.

I am not limited to any particular size of the elongate food dispensing member 14, but the length of the member is typically two or three times as great as its diameter.

As can be easily seen, readily dissolved food items may be inserted into the food dispensing member or mesh bag 14 through the open end 34 thereof, with such food items being in the nature of pieces of bread, pieces of cookie, potato, pieces of pretzel, Jello and other solid or semi-solid foods. Upon the handle 12 being attached and the elongate container 14 placed in the mouth of the infant or impaired adult, this person can commence receiving nutrition shortly after the food items become saturated with his or her saliva. If the person is able to masticate, the food that has been placed in the elongate container can be chewed or broken down into small enough pieces to pass through the mesh bag. The mesh is of fine enough weave as to assure no large particles coming through that would pose a choking-type jeopardy to the person.

After the person on his own removes the feeding device or falls asleep, the mother or other care giver can remove the feeding device and then proceed to unscrew the closure ring 16 so that any remaining pieces of food in the food dispensing container 14 can be removed. Thereafter, all of the components 12, 14 and 16 can be sterilized for subsequent reuse. Unlike some previous designs, the elongate mesh container 14 of this invention can be turned inside out for thorough cleaning.

The size of the mesh openings of the elongate food dispensing member utilized in a given instance can be chosen with regard to the physical size and health of the person involved. Typically, a relatively small mesh would be utilized with an infant, whereas a larger mesh could be utilized by a care giver when feeding an adult with a physical or mental impairment.

Some embodiments of the mesh utilized in accordance with my invention have involved something on the order of eight openings per lineal inch, whereas other embodiments have had approximately eighteen openings per lineal inch.

Stated in terms of openings per square inch, these can range between 64 openings and 324 (or more) openings per square inch, but I am not to be limited to this.

Although my other Baby Safe Feeders have been commercially successful, the instant design offers significant advantages from the standpoints of the convenient loading of the elongate mesh bag with soft food, and then, after use, the simplified cleaning of the bag by virtue of the bag being easily turned inside out. Because the mesh bag is not directly attached to any threaded component, it is inexpensive to manufacture, and can be discarded and replaced with a new mesh bag when such is needed.

I claim:

1. A device for feeding a young child or impaired adult without the threat of the person choking, said device comprising:

a handle member in combination with an elongate food-receiving container of mesh material, one end of said container having an aperture in which ring means is mounted, said handle member having a circularly configured handle end around which is defined a circularly disposed sealing surface and around the adjacent exterior surface of said handle end securing means are disposed;

a closure ring having securing means around its interior surface, with said securing means of said handle end and of said closure ring able to interfit and be tightened so as to be interlocked together, said closure ring having a central aperture around which is disposed an inner shoulder, said inner shoulder being of a size to closely receive said ring means but not permitting the passage therethrough of said ring means; and whereby when said elongate container with food therein has been inserted through said aperture in said closure ring and said closure ring has been tightened upon said handle end, said inner shoulder will cause said ring means to tightly engage said circularly disposed sealing surface, said elongate container being placable in the mouth of a person to enable semi-solid food in said container to at least partially dissolve in the mouth of the person.

2. The device for feeding a young child or impaired adult without the threat of the person choking as recited in claim 1 in which said securing means of said closure ring and of said handle end are interfitting threads.

3. The device for feeding a young child or impaired adult without the threat of the person choking as recited in claim 1 in which said ring means is made of rigid material.

4. The device for feeding a young child or impaired adult without the threat of the person choking as recited in claim 1 in which said ring means is made of semi-rigid material.

5. A device for feeding a young child or impaired adult without the threat of the person choking, said device comprising:

a handle member in combination with an elongate food-receiving container of mesh material, one end of said container being closed but the other end containing an aperture in which ring means is mounted, with said ring means being of a sufficiently large diameter as to make it highly unlikely that said elongate container could be swallowed by a child or impaired adult;

said handle member having a circularly configured handle end around which is defined a circularly disposed sealing surface and around the adjacent exterior surface of said handle member securing means are disposed;

a closure ring utilized in operative association with said handle end around the interior surface of which closure ring securing means complementary to said securing means on said handle end are disposed, with said securing means of said handle end and said closure ring able to interfit and be tightened so as to be interlocked together, said closure ring having a central aperture for receiving said food-receiving container with an inner shoulder disposed around said aperture, said inner shoulder being of a size to closely receive said ring means, but not permitting the passage of said ring means through said aperture; and whereby when said elongate container with food therein has been inserted through said aperture in said closure ring and said closure ring has been tightened upon said handle end, said inner shoulder will cause said ring means to tightly engage said circularly disposed sealing surface, said elongate container being placable in the mouth of a person to enable the food in said container to at least partially dissolve in the mouth of the person.

6. The device for feeding a young child or impaired adult without the threat of the person choking as recited in claim 5 in which said securing means of said closure ring and of said handle end are interfitting threads.

7. The device for feeding a young child or impaired adult without the threat of the person choking as recited in claim 5 in which said ring means is made of rigid material.

8. The device for feeding a young child or impaired adult without the threat of the person choking as recited in claim 5 in which said ring means is made of semi-rigid material.

9. A device for feeding a young child or impaired adult without the threat of the person choking, said device comprising:

a handle member in combination with a food-receiving member in the form of an elongate container of mesh material in one end of which container an aperture is located, said handle member having a circularly configured handle end around which is defined a circularly disposed sealing surface, and around the adjacent exterior surface of said handle member securing means are disposed;

a closure ring having a central aperture, said closure ring utilized in operative association with said handle end around the interior surface of which closure ring securing means complementary to said securing means on said handle end are disposed, with said securing means of said handle end and said closure ring able to interfit and be tightened so as to be interlocked together;

ring means serving to hold said aperture of said elongate container in an open position to simplify the placement of relatively soft food in said container, with said ring means being of a sufficiently large diameter as to make it highly unlikely that said elongate container could be swallowed by a child or impaired adult; and said aperture of said closure ring sized to receive said food-receiving container with an inner shoulder formed around said aperture, said inner shoulder being of a size to closely receive said ring means but not permitting the passage of said ring means through said aperture, such that when said elongate container with food therein has been inserted through said aperture in said closure ring and said closure ring has been tightened upon said handle end, said inner shoulder will cause said ring means to tightly engage said circularly disposed sealing surface, whereby said food-containing elongate container can be placed in the mouth of the person to enable the food in said container to at least partially dissolve in the mouth of the person.

10. The device for feeding a young child or impaired adult without the threat of the person choking as recited in claim 9 in which said securing means of said closure ring and of said handle end are interfitting threads.

11. The device for feeding a young child or impaired adult without the threat of the person choking as recited in claim 9 in which said ring means is made of rigid material.

12. The device for feeding a young child or impaired adult without the threat of the person choking as recited in claim 9 in which said ring means is made of semi-rigid material.

13. A device for feeding a young child or impaired adult without the threat of the person choking, said device comprising:

a handle member in combination with a closure ring and a food-receiving member;

said food-receiving member being in the form of an elongate container of mesh material, one end of said elongate container being closed and the other end containing an aperture permitting the insertion of semi-solid food into said elongate container;

ring means serving to hold said aperture of said elongate container in an open position to simplify the placement of food in said container, said ring means being of a diameter as to make it highly unlikely that said elongate container could be swallowed by a child or impaired adult;

said handle member having a circularly configured handle end around which is defined a circularly disposed sealing surface, said sealing surface being of approximately the same diameter as said ring means;

securing means disposed around an exterior surface of said circularly configured handle end;

said closure ring having a central aperture for receiving said elongate container in which food has been placed around which aperture is disposed an inner shoulder of a diameter to closely receive said ring means but not permitting said ring means to pass through, said closure ring being utilized in operative association with said handle end, said closure ring having an interior surface around which securing means are disposed which are complementary to said securing means around said handle end, with said securing means of said handle end and of said closure ring able to interfit such that upon such securing means being moved relatively, they will become interlocked together and, upon being interlocked, said inner shoulder of said closure member will cause said ring means to tightly engage said circularly disposed sealing surface, such that said food-containing elongate container, upon thereafter being placed in the mouth of the person, enables the food to at least partially dissolve in the mouth of the person.

14. The device for feeding a young child or impaired adult without the threat of the person choking as recited in claim 13 in which said securing means of said closure ring and of said handle end are interfitting threads.

15. The device for feeding a young child or impaired adult without the threat of the person choking as recited in claim 13 in which said ring means is made of rigid material.

16. The device for feeding a young child or impaired adult without the threat of the person choking as recited in claim 13 in which said ring means is made of semi-rigid material.

17. A device for feeding a young child or impaired adult without the threat of the person choking, said device comprising:

a handle member in combination with a closure ring and a food-receiving member;

said food-receiving member being in the form of an elongate container of mesh material with one end of said elongate container being closed and the other end containing an aperture;

ring means serving to hold said aperture of said elongate container in an open position to simplify the placement of food in said container, said ring means being of a diameter as to make it highly unlikely that said elongate container could be swallowed by a child or impaired adult;

said handle member having a circularly configured handle end around which is defined a circularly disposed sealing surface, said sealing surface being of approximately the same diameter as said ring means;

securing means disposed around an adjacent exterior surface of said circularly configured handle end;

said closure ring having a central aperture for receiving said elongate container in which food has been placed around which aperture is disposed an inner shoulder of a diameter to closely receive said ring means but not permitting said ring means to pass through, said closure ring being utilized in operative association with said handle end, said closure ring having an interior surface around which securing means are disposed which are complementary to said securing means on said handle end, with said securing means of said handle end and of said closure ring able to interfit with such securing means being movable relatively so as to be interlocked together, such that when said closure ring has been tightened upon said handle end, said inner shoulder will cause said ring means to tightly engage said circularly disposed sealing surface, said food-containing elongate container, upon being placed in the mouth of the person, enables the food to at least partially dissolve in the mouth of the person.

18. The device for feeding a young child or impaired adult without the threat of the person choking as recited in claim 17 in which said securing means of said closure ring and of said handle end are interfitting threads.

19. The device for feeding a young child or impaired adult without the threat of the person choking as recited in claim 17 in which said ring means is made of rigid material.

20. The device for feeding a young child or impaired adult without the threat of the person choking as recited in claim 17 in which said ring means is made of semi-rigid material.

* * * * *